United States Patent [19]

Sheehan

[11] Patent Number: 4,655,176

[45] Date of Patent: Apr. 7, 1987

[54] ADJUSTABLE RATIO ROLLER ROCKER FOR INTERNAL COMBUSTION ENGINES

[75] Inventor: Kevin A. Sheehan, 1509 Weaverly Dr., Petaluma, Calif. 94952

[73] Assignee: Kevin A. Sheehan, Petaluma, Calif.

[21] Appl. No.: 804,911

[22] Filed: Dec. 5, 1985

[51] Int. Cl.[4] ..... F01L 1/34

[52] U.S. Cl. ..... 123/90.16; 123/90.39

[58] Field of Search ..... 123/90.39, 90.15, 90.16

[56] References Cited

U.S. PATENT DOCUMENTS

| | | | |
|---|---|---|---|
| 1,395,851 | 11/1921 | McLean | 123/90.39 |
| 1,483,267 | 2/1924 | Asplund | 123/90.16 |
| 1,654,020 | 12/1927 | Schmidt | 123/90.39 |
| 4,077,369 | 3/1978 | Buehner | 123/90.16 |
| 4,182,290 | 1/1980 | Pohle | 123/90.39 |
| 4,187,810 | 2/1980 | Buehner | 123/90.39 |
| 4,365,785 | 12/1982 | Miller | 123/90.39 |
| 4,519,345 | 5/1985 | Walter | 123/90.16 |

FOREIGN PATENT DOCUMENTS

| | | | |
|---|---|---|---|
| 1011874 | 4/1984 | U.S.S.R. | 123/90.39 |

*Primary Examiner*—Ira S. Lazarus

[57] ABSTRACT

This roller rocker is designed to change the valve lifter rocker arm leverage of an engine to increase the engine's performance. Primarily, it consists of a sliding pushrod seat, and a threaded Allen bolt is threaded into an opening in the sliding pushrod seat for traversing the seat in an opening in the body of the rocker arm. The design also includes a locking ring to retain the bolt, and an Allen set screw is received in the arm to lock the Allen bolt in its setting.

2 Claims, 3 Drawing Figures

ADJUSTABLE RATIO ROLLER ROCKER FOR INTERNAL COMBUSTION ENGINES

BACKGROUND OF THE INVENTION

1. Field of the Invention

This invention relates to valve operating mechanisms, and, more particularly, to an adjustable ratio roller rocker for internal combustion engines.

2. Description of Prior Art

References of record are S. F. Briggs U.S. Pat. No. 3,189,001, W. A. Pohle U.S. Pat. No. 4,182,290, B. F. Schmidt U.S. Pat. No. 1,654,020, and J. F. Buehner U.S. Pat. No. 4,187,810. In high performance internal combustion engines, it is frequently desirable to have the capability of changing the valve lifter rocker arm leverage ratio to adapt engine performance and economy to suit certain atmospheric conditions and physical characteristics of the racetracks. It is common practice to accomplish this change by the physical substitution of an entire rocker arm, having the desired leverage ratio, a procedure which is costly from the standpoint of both time and money. The problems of the known Crane VR rocker is that one only has the choice of three ratios, but one has to remove the rocker off of the engine, so as to insert the middle ratio seat. The "VR" rocker also cannot be made with off-set pushrod seats, so as to clear widened intake ports. It has also been found by people who build racing engines, that the "VR" rocker has a tendency to crack around the pushrod seat insert. The adjustable ratio roller rocker, in accordance with the present invention, which is nicknamed "AR" for short, is an addition to a normal roller rocker.

The principal object of this invention is to provide an adjustable ratio roller rocker for internal combustion engines, which will be unique in design, as it will make the known Crane "VR" rocker obsolete, because the present invention is such, that the ratio setting can be made to move 0.01 setting at a time, and it includes thirty different stops in all. However, the actual number of stops and spread of ratio may be different, depending on actual manufacture and different engine designs.

Another object of this invention is to provide an adjustable ratio roller rocker for internal combustion engines, which will be of such design, as to not need the pulling off of the rocker to change to a different ratio, and it will only take two Allen wrenches to change a setting which will take approximately ten seconds per rocker.

Another object of this invention is to provide an adjustable ratio roller rocker for internal combustion engines, which will substantially increase the volumetric efficiency of an engine, by power balancing each cylinder for each to put out equal power regardless of variations in intake manifold, heads, valves, actual cam base lift variations, and flexing of parts, etc.

A further object of this invention is to provide an adjustable ratio roller rocker for internal combustion engines, which will be of such design, as to be adaptable for use on any pushrod valve activated engine, and it will enable auto manufacturers flexibility from state to state for preparing their engines for best power and clean air emissions.

SUMMARY OF THE INVENTION

Figure 1:
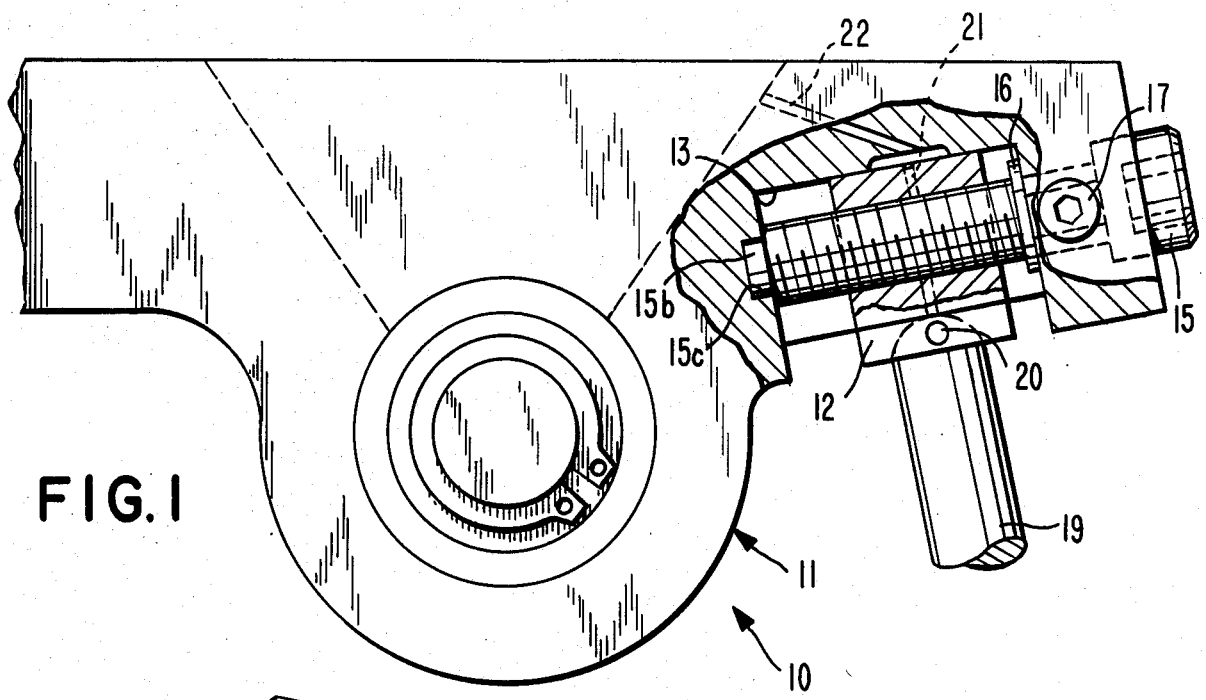
FIG. 1 is a side elevational view of the present invention.
Figure 2:
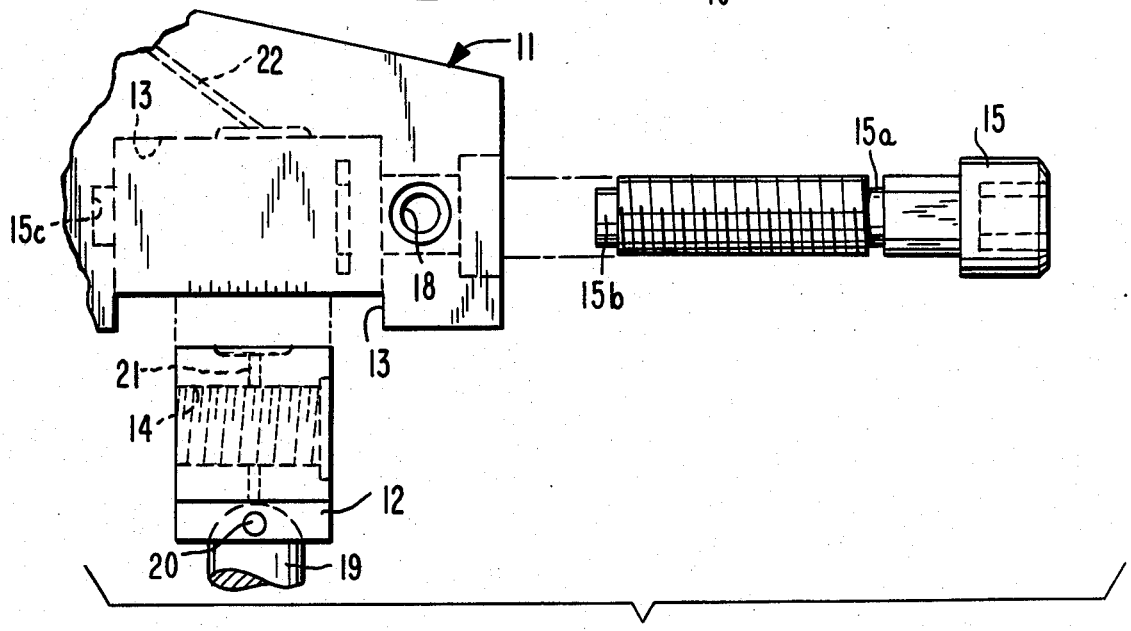
FIG. 2 is an exploded side elevational view of the invention.
Figure 3:
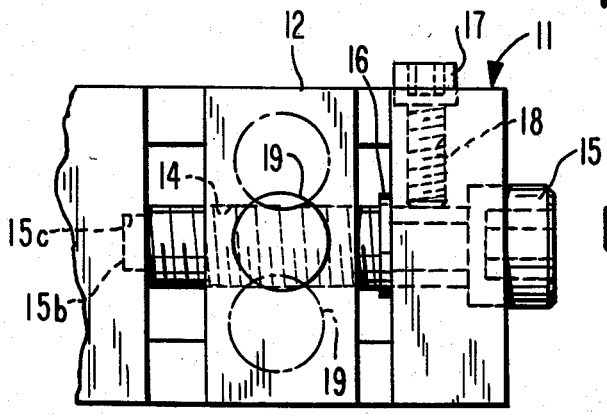
FIG. 3 is a bottom plan view of the invention, showing off-set pushrod locations in phantom lines.

This invention is directed to the problem of changing the valve lifter rocker arm leverage ratio in the operation of an internal combustion engine, without substituting a different rocker arm, and by using the simplest and most trouble-free mechanism. The design comprises a sliding pushrod seat insert which is inserted in the pushrod side of the rocker. The sliding seat insert is internally threaded to combine with a specially made Allen bolt which one turns to change to the ratio desired. When the desired ratio is reached, the Allen set screw on the side of the rocker is turned. The Allen head bolt is held from backing out by an internal "C"-clip or other kind of retaining device on the inside of the rocker.

DETAILED DESCRIPTION

Accordingly, a rocker 10 is shown to include a body 11, having a sliding pushrod seat 12 received in the opening 13 at one end of the body 11. A threaded opening 14 is provided through pushrod seat 12 and threadingly receives a specially designed Allen bolt 15, and Allen bolt 15 includes an annular groove **15*a* that receives a "C"-clip 16 to retain bolt 15 in body 11. Allen bolt 15 also includes an end nipple 15*b* which is integrally attached thereto, for being received in the opening 15*c* of body 11, and an Allen set screw 17 is provided and is threadingly received in a threaded opening 18 through one side of body 11, for retaining Allen bolt 15 at its setting. The pushrod 19 is received in pushrod seat 12, center line of said pushrod is indicated by marker 20, to correspond to markings on side of 11, and an oil passage 21 is provided in seat 12 for the lubrication thereof through passage 22 in body 11**.

In use, Allen set screw 17 is loosened by wrench means, and Allen bolt 15 is rotated by wrench means to cause seat 12 to slide for a particular setting of the pushrod 19, and it shall be noted, that marking on the side of the body 11 may be incorporated to correspond with the center line of pushrod seat 12, for visually locating where the ratio is set at. When the setting is accomplished, the Allen set screw 17 is again tightened.

It shall further be recognized that the design may be modified to receive an off-set pushrod seat, by merely changing seat 12.

While various changes may be made in the detailed construction, such changes will be within the spirit and scope of the present invention, as defined by the appended claims.

What I now claim is:

1. An adjustable ratio roller rocker for internal combustion engines, comprising, a body, a sliding pushrod seat received in said body, a bolt received in said sliding pushrod seat, a pushrod received in said sliding pushrod seat and said sliding pushrod seat includes a threaded opening that receives said bolt, and the rotation of said bolt causes said sliding pushrod seat to traverse a recessed opening in said body.

2. An adjustable ratio roller rocker for internal combustion engines, comprising, a body, a sliding pushrod seat received in said body, a bolt received in said sliding pushrod seat, a pushrod received in said sliding pushrod seat and an annular groove is provided in the outer periphery of said bolt and removably receives a C-clip that retains said bolt in the recessed opening in said body.

* * * * *